United States Patent [19]

Wiand

[11] 4,047,902

[45] Sept. 13, 1977

[54] METAL-PLATED ABRASIVE PRODUCT AND METHOD OF MANUFACTURING THE PRODUCT

[76] Inventor: Richard K. Wiand, 1773 Washington, Birmingham, Mich. 48009

[21] Appl. No.: 699,591

[22] Filed: June 24, 1976

Related U.S. Application Data

[63] Continuation-in-part of Ser. No. 564,077, April 1, 1975, abandoned.

[51] Int. Cl.[2] ..... B24D 11/04

[52] U.S. Cl. ..... 51/295; 51/309 R

[58] Field of Search ..... 51/295, 309, 297

[56] References Cited

U.S. PATENT DOCUMENTS

| | | | |
|---|---|---|---|
| 1,988,065 | 1/1935 | Wooddell | 51/293 |
| 2,015,658 | 10/1935 | Bezzenberger | 51/293 |
| 2,876,086 | 3/1959 | Raymond | 51/293 |
| 3,199,254 | 8/1965 | Barron | 51/309 |
| 3,306,719 | 2/1967 | Fringhian | 51/309 |
| 3,860,400 | 1/1975 | Prowse et al. | 51/295 |
| 3,918,217 | 11/1975 | Oliver | 51/295 |

*Primary Examiner*—Donald J. Arnold

*Attorney, Agent, or Firm*—Harness, Dickey & Pierce

[57] ABSTRACT

A new abrasive product using abrasive particles, such as diamond particles, with the abrasive particles being positioned on the products by the use of a special masking technique and with abrasive particles being held in place by deposited metal; and, a new method of manufacturing said product.

10 Claims, 2 Drawing Figures

METAL-PLATED ABRASIVE PRODUCT AND METHOD OF MANUFACTURING THE PRODUCT

BACKGROUND OF THE INVENTION

This application is a continuation in part of copending parent application Ser. No. 564,077 filed Apr. 1, 1975, now abandoned.

This invention broadly relates to a new abrasive product and method of manufacturing same.

The state of the art disclosures are indicated by the following cited references: U.S. Pat. Nos. 3,661,137; 3,762,895; 3,293,012; 3,663,191; 3,713,795; 3,306,719; 2,876,086; 2,740,239; 2,778,169; 2,705,194 and, "Nickel Plated Diamond Tools" article by Lindenbech et al., Industrial Diamond Review, March 1974, pages 84–88, and the references cited in said parent application file, all of which disclosures are incorporated herein by reference.

One object of the present invention is to provide a new abrasive product which is economical to manufacture and which possesses uniquely high endurance qualities over extended periods of usage.

Another object of this present invention is to provide a new abrasive product and method of manufacturing the same wherein the product utilizes a special masking technique to provide for economical and efficient manufacturing thereof; and/or to provide such a product which possesses excellent swarf clearance.

Another object of the present invention is to provide a new abrasive product wherein a masking material is used in the product to provide specially predetermined desired exposed surface portions on said product where abrasive particles are secured to the exposed positions.

Another object of this invention is to provide a method by which the abrasive particles (for example diamond particles) can be applied to this surface with a low per unit density, that is, a small amount of abrasive particles per square inch of surface. Furthermore, the product herein is adaptable in that it can be rigid or flexible.

Another object of this invention is to provide a new abrasive product (product tool or article) and method of manufacturing the same, wherein a masking material is used to position the abrasive particles and wherein the abrasive particles are held in place by deposited metal.

Another object of the invention is to provide a new abrasive product, and method of manufacturing same, wherein the plating of the diamond particles to the unmasked positions does not affect the flexibility of the product.

SUMMARY OF THE INVENTION

Briefly stated the present invention concerns an abrasive product comprising a backing member, a removable or non-removable masking media generally overlying said backing and providing selected exposed portions on the backing; diamonds or other abrasive particles generally positioned on said exposed positions, and a metal deposit on said backing member generally at said exposed portions for holding said abrasive particles in position.

The abrasive carrying backing which is preferably in sheet form (but can be, for example, the O.D. of a "wheel" type solid tool) may be flat or bent, or the sheet may be formed into a tube or cylinder which then can be combined with a solid rigid or flexible substrate.

The abrasive carrying backing may be rigid or non-rigid having a masking material to provide specially predetermined selected exposed surface portions on said backing which, and said portions may be pretreated by metal deposits, embossing or the like to change the character of the exposed portions.

From a method aspect, briefly stated, the present invention concerns a method of manufacturing an abrasive product comprising: (a) providing a conductive or metallic backing member, (b) masking off predetermined desired surface portions on the backing member to thereby leave exposed spaced apart portions on the backing, (c) bonding abrasive grit particles to the exposed portions, said bonding being carried out by a metal plating process.

Other objects, features and advantages of the present invention will become apparent from the subsequent description and the appended claims taken in conjunction with the accompanying drawings.

DESCRIPTION OF PREFERRED EMBODIMENTS

Figure 1:
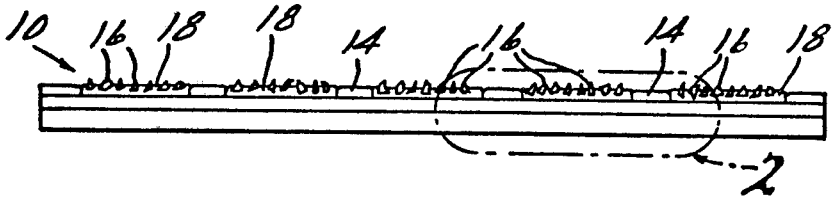
FIG. 1 illustrates a preferred embodiment of the new abrasive product in accordance with this invention; and, FIG. 2 illustrates an enlarged view of the area designated "2" in FIG. 1.
Figure 2:
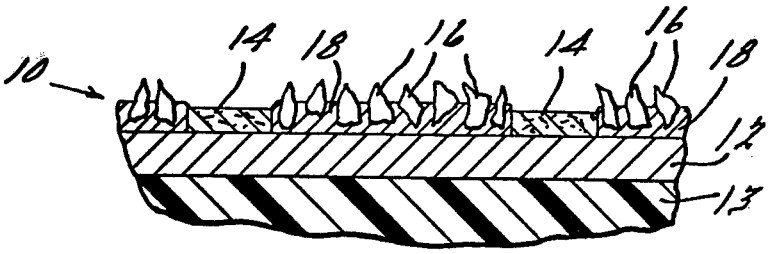

With references to the drawing, the method of manufacturing a new abrasive product generally designated 10 is carried out by masking a platable conductive substrate or backing designated 12 with a masking material or perforated non-conductive material 14. The perforations in the masking material 14 can be of any suitable shape, spacing, design, or pattern and for example, can be of varying hole size to permit varying percent of surface exposure. Also varying shapes of perforations and/or arrangements of perforations can be used. The platable conductive substrate 12 itself can be preperforated and then masked or it can be in essentially solid shape and then masked prior to the plating operation. The perforations in the conductive platable substrate 12 can also be of varying shape and/or hole size as well as taking up varying percentages of the surface of the platable conductive substrate. The conductive substrate 12 may also suitably be supported by a support member 13, which may be of either a flexible or rigid nature. The support member 13 can satisfactorily be formed of a number of different materials such as plastic, fiberglass, metal, wood, rubber or the like.

The platable substrate 12 can be rigid or flexible and it is preferably a material which is metalized on one surface thereof to give a conductive surface for the subsequent plating operation which bonds the abrasive particles to the conductive substrate. Also the conductive platable substrate 12 can preferably be made of metallic filled plastic materials, or, even from non-conductive materials whereby the abrasive particles are bonded by chemical reduction or vacuum metal deposition. As shown in the drawings, the abrasive particles 16 are bonded in place by the metal plating 18, as further described below.

The masking material 14 can be of a number of different materials, such as masking tape, silk screening materials, rubber materials, an unplatable metal (e.g., titanium) a thin plastic, a painted material and various shapes of masking materials which are applied to the conductive substrate. Hot stamping to leave exposed areas in the conductive platable substrate is also possible for the purpose of carrying out the masking techniques, or a photoresist method can also be used to carry out the masking. By the term masking as used herein it is generally meant to include any of the above techniques.

The plating operations to bond the abrasive particles 16 to the substrate 12 may suitably be electrolytic, chemical reduction or vacuum metal deposition. However, it is preferred to use an electroplating technique with a conductive substrate 12. The preferred electroplating technique to bond the abrasive particle 16 to the conductive surface is generally carried out using the following steps. First, the conductive platable substrate or tool on which the abrasive particles 16 are to be positioned is properly mounted or maintained for subsequent application of the following manufacturing steps. The properly positioned tool is then treated such that the conductive surface of the substrate is prepared for adhesion of the metal plating. Temporary or initial adhesion of the abrasive particles is then carried out by a small application of the metal plating 18. Lastly the balance of the metal plating 18 is applied to finally bond the abrasive particles 16 to the conductive substrate 12. Following this the masking material 14, which is removable can be pulled away or left in place as desired. The inventive product herein can also be prepared as generally described above, and by raising the conductive surface above the plane of the surface by making a solid metal deposit through electroplating, then electroplating the diamonds or abrasive particles on top of the initial raised plating. The product herein also includes a method whereby there is used a laminated body with a conductive material between two non-conductive layers which, by embossing or stamping, from the rearward side thereof, causes the conductive material to be exposed. Then the plating is applied on this exposed area. The preferred abrasive particles or grit for use in forming the products disclosed herein are generally of the non-ferromagnetic type. Very good results are obtained with diamond abrasive particles. Particularly suitable for this purpose is natural grit 60/80 U.S. mesh size or synthetic grit 60/80 U.S. mesh size may also be used. Other diamond abrasive particles may also be used of varying particle sizes. Also it is suitable in accordance with this invention to use abrasive particles which may be comprised of cubic boron nitride, glass, sand, silicon, carbide, and/or aluminum oxide.

The metal plating used to bond the abrasive particles to the conductive substrate may be any number of different metal platings such as nickel, bronze, gold or the like. The bonding of the abrasive particles with the metal plating is generally carried out with a static plating process, or technique as opposed to a dynamic or moving process. Furthermore the grit particles and the metal plating binder are applied generally simultaneously in carrying out the bonding operation. A nickel metal plating is the preferred plating material for bonding the abrasive particles to the conductive substrate. An example of a suitable nickel plating bath for carrying out the manufacture of the new product herein is as follows:

Nickel Sulfate: 260 grams per liter
Nickel Chloride: 34 grams per liter
Boric Acid: 32 grams per liter
pH: maintained at approximately 3.0
Temperature: approximately 52° C.
Current Density: approximately 3–4 amps per square desometer Highly suitable and advantageous products can be made with this invention, such as abrasive or grinding wheels of numerous different shapes and sizes. These abrasive wheels may have either a planar or peripheral abrading surface. From the inventive disclosure given herein it should be readily apparent that abrading devices which are very advantageous and practical for commercial and home usage are possible.

While it will be apparent that the preferred embodiments of the invention disclosed are well calculated to fulfill the objects above stated, it will be appreciated that the invention is susceptable to modification, variation and change without departing from the proper scope or fair meaning of the subjoined claims.

What is claimed is:

1. A method of manufacturing an abrasive product comprising, providing a conductive member with a surface thereon for attachment of abrasive particles, masking off predetermined desired surface portions on the backing member to thereby leave exposed spaced apart portions on the backing, a significant plurality of said abrasive grit particles positioned on each said exposed portions, bonding generally non-ferromagnetic abrasive grit particles to the exposed portions subsequent to the masking, said bonding being effected by a deposited metal plating technique of either the electrolytic, electroless, or vacuum deposition type and, said grit particles and said metal plating being applied to the product generally simultaneously in a generally static plating technique.

2. The invention of claim 1 wherein, said plating is a nickel plating.

3. The invention of claim 1 wherein, said backing member is embossed from a rearward side thereof to form said exposed portions on the opposite side into raised portions so that the grit particles bonded thereto are raised relative to the plane of the backing member.

4. The invention of claim 1 wherein, said backing member has an underlying support means to provide further support to said product.

5. The invention of claim 1 wherein, said backing member is made of either a metal sheet, or a perforated metal sheet.

6. The invention of claim 1 wherein, said masking is carried out with a removable masking material, said particles are diamond abrasive grit, said plating is a nickel plating, said backing member is embossed from a rearward side thereof to form said exposed portions on the opposite side into raised portions so that the grit particles bonded thereto are raised relative to the plane of the backing member, said backing member has an underlying support means to provide further support to said product, and said conductive backing member is made of either a metal sheet, or a perforated metal sheet.

7. The product made by the method of claim 1.

8. The product made by the method of claim 6.

9. The invention of claim 1 wherein said abrasive grit is at least one material selected from the group consisting of diamond, boron nitride, glass, sand, silicon carbide, or aluminum oxide.

10. The invention of claim 2 wherein said abrasive grit is at least one material selected from the group consisting of diamond, boron nitride, glass, sand, silicon carbide, or aluminum oxide.

* * * * *

UNITED STATES PATENT AND TRADEMARK OFFICE

CERTIFICATE OF CORRECTION

PATENT NO. : 4,047,902

DATED : September 13, 1977

INVENTOR(S) : Richard K. Wiand

It is certified that error appears in the above-identified patent and that said Letters Patent are hereby corrected as shown below:

Column 4, line 17 (Claim 1, line 3) after the words "providing a conductive" insert the word -- backing --.

Signed and Sealed this

*Twenty-seventh* Day of *December 1977*

[SEAL]

*Attest:*

RUTH C. MASON
*Attesting Officer*

LUTRELLE F. PARKER
*Acting Commissioner of Patents and Trademarks*